United States Patent [19]

Simjian

[11] 4,402,511

[45] Sep. 6, 1983

[54] GOLF PUTTING TRAINING DEVICE

[75] Inventor: Luther G. Simjian, Fort Lauderdale, Fla.

[73] Assignee: Command Automation Inc., Greenwich, Conn.

[21] Appl. No.: 377,126

[22] Filed: May 11, 1982

[51] Int. Cl.[3] ..... A63B 69/36

[52] U.S. Cl. ..... 273/183 C; 273/DIG. 14

[58] Field of Search ..... 273/183 C, 199 R, 213, 273/200 R, 200 B, 199 A, DIG. 14, 58 K, 58 B, 58 BA

[56] References Cited

U.S. PATENT DOCUMENTS

| | | | |
|---|---|---|---|
| 3,796,435 | 3/1974 | Dale | 273/183 C |
| 3,918,720 | 11/1975 | Gordos | 273/199 R |
| 4,278,254 | 7/1981 | Simjian | 273/183 C |

OTHER PUBLICATIONS

Golf Digest, Mar. 1979, p. 126.

*Primary Examiner*—George J. Marlo

[57] ABSTRACT

A golf putting device is described which comprises a golf ball, or a golf ball simulating device, disposed in a transparent cylindrical tubing which is provided with a set of rims for rolling contact with surface a along which the putting device is propelled.

6 Claims, 3 Drawing Figures

GOLF PUTTING TRAINING DEVICE

SUMMARY OF THE INVENTION

This invention relates to golf training devices and more particularly concerns a device for improving the putting skill of a golf player. Quite specifically, this invention refers to a golf putting device which reveals quickly whether a golf ball would have been addressed properly so as to be propelled in a straight forward path toward the cup. The putting device described hereinafter is particularly suited for indoor exercise or for putting on a mat disposed on plane ground or flooring. The main advantage of the present device resides in its ability to clearly and convincingly reveal whether the golf ball upon being struck would have rolled in the desired direction, that is, toward the cup, or would have wandered along a non-desired direction. Thus, it will be possible by the use of the device described herein to correct any faulty stance or an incorrect putting stroke.

This invention is related, moreover, to a golf putting device as disclosed in my previously issued U.S. Pat. No. 4,278,254 dated July 14, 1981 which describes a similar device. The present invention discloses a modified design for a golf putting device which is characterized by inherent simplicity.

As is well known to golfers, putting forms a most important aspect of a game and in many instances is decisive whether a game is won or lost. Great effort is made, even by professional players, to improve the skill of putting. Most putting training is done by repetitively putting, that is, striking the ball on even ground and propelling the ball a short distance toward a marker or cup. While this exercise is helpful in achieving the proper skill, the putting device disclosed hereinafter provides a fast and most discernible view of this putting effort. Quite specificaly, the deviation of the ball from its desired path due to a failure to address the ball properly, i.e. squarely, is immediately evident. Corrective action taken by the golfer and the result thereof, once again, become apparent most quickly and most convincingly.

One of the principal objects of this invention is therefore the provision of a new and improved putting device for golf players.

Another important object of this invention is the provision of a novel putting device which when struck by a golf putter clearly reveals whether the putting device was addressed properly.

Still another object of this invention is the provision of a new and simplified golf putting device.

A further significant object of this invention is the provision of a golf putting device which, while being simple in construction, improves the putting ability of a golf player and provides immediate feedback of any wrong action or stance.

Other and still further objects of this invention will become more clearly apparent from the following description when taken in conjunction with the accompanying drawings.

DESCRIPTION OF THE INVENTION

Figure 1:
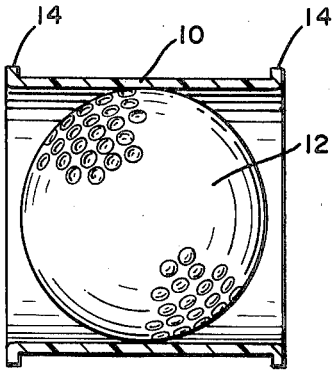
FIG. 1 is a top plan view, partly in section, of a typical embodiment of the invention.

Referring now to the figures and FIG. 1 in particular, numeral 10 identifies a substantially rigid cylindrical tubing, preferably made of substantially transparent plastic material. A golf ball 12 of conventional size or slightly deviating therefrom is disposed in said tubing and held therein by a compression fit or by suitable bonding means, such as epoxy resin. The ends of the tubing 10 are turned up to form a set of rims 14 which provide rolling contact between the golf putting device and the underlying surface.

A golf putter using the described device essentially views a golf ball through the tubing 10 and if the device is addressed squarely, the putting device will roll forward along a straight direction. If the device is addressed incorrectly, i.e. not squarely, the putting device will travel along a curved path depending upon the angle at which the device is struck.

Figure 2:
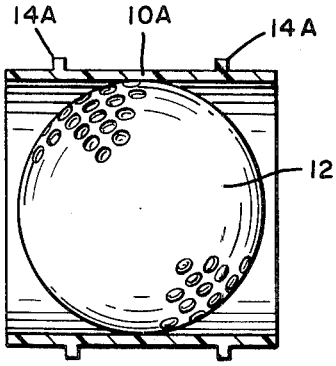
FIG. 2 is a top plan view, partly in section, of another embodiment of the invention.

FIG. 2 shows a slight modification of the design. The rims 14A are moved toward the center of rotation of the ball 12, thereby making any error in addressing the ball more pronounced. The sleeve 10A may be molded so that the rims 14A constitute an integral part of the sleeve 10A.

Figure 3:
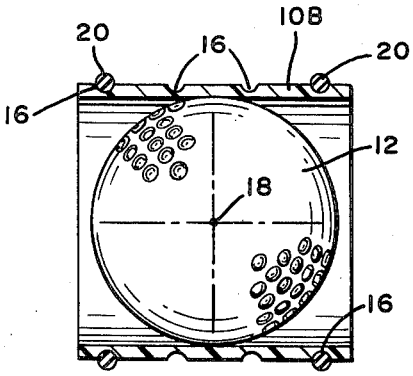
FIG. 3 is a top plan view, partly in section, of still another embodiment of the invention.

FIG. 3 shows a further construction of the golf putting device. The sleeve 10B is provided with a plurality of circumferential grooves 16 spaced at various distances relative to the center of rotation 18 of the ball 12. A set of bands 20 made preferably of elastic material, such as rubber, are disposed in selected grooves, the selection of the grooves being made by the golfer to suit his skill. For instance, as the skill of the golfer advances, the bands are changed from the outer set of grooves to the inner set of grooves. In its simplest embodiment, each band 20 may comprise a heavy rubber band of circular or square or rectangular cross-section. Most suitable, for instance, will be an O-ring gasket available from many commercial sources.

While there have been described and illustrated several preferred embodiments of my invention, it will be apparent to those skilled in the art that several changes and modifications may be made without deviating from the principle of my invention which shall be limited only by the scope of the appended claims.

What is claimed is:

1. A golf putting device comprising:
   a substantially transparent tubing:
   a spherical member having the appearance of a golf ball disposed in said tubing, and
   a pair of rims for providing rolling contact with a supporting surface encircling said tubing.

2. A golf putting device as set forth in claim 1, said tubing being cylindrical and rigid.

3. A golf putting device as set forth in claim 2, said rims forming an integral part of said tubing.

4. A golf putting device as set forth in claim 2, said rims being elastic bands assembled upon said tubing.

5. A golf putting device as set forth in claim 4, said tubing being provided with circumferential grooves for receiving therein said bands.

6. A golf putting device as set forth in claim 5, said tube having a plurality of circumferential grooves spaced axially along said tubing relative to the center of rotation of said spherical member for receiving therein said bands for causing said bands to be disposed in selected ones of said grooves.

* * * * *